United States Patent [19]

Keffeler

[11] 4,372,445

[45] Feb. 8, 1983

[54] MEDICATION DISPENSER

[76] Inventor: Paul J. Keffeler, 9706 Brentwood, Omaha, Nebr. 68114

[21] Appl. No.: 235,933

[22] Filed: Feb. 19, 1981

[51] Int. Cl.[3] ..... B65D 83/04

[52] U.S. Cl. ..... 206/532; 206/538; 206/561; 206/601; 220/22

[58] Field of Search ..... 206/538, 532, 601, 539, 206/498; 220/306, 307, 22, 20

[56] References Cited

U.S. PATENT DOCUMENTS

| | | | |
|---|---|---|---|
| D. 149,519 | 5/1948 | Reynolds | D58/13 |
| 2,125,856 | 8/1938 | DeWitt | 220/22 |
| 2,538,924 | 1/1951 | Stearn | 206/65 |
| 2,917,162 | 12/1959 | Horland | 206/538 |
| 3,393,794 | 7/1968 | Borin | 206/42 |
| 3,703,955 | 11/1972 | Inacker | 206/42 |
| 3,771,695 | 11/1973 | Pehr | 206/538 |
| 3,807,551 | 4/1974 | Ankeny | 206/42 |
| 3,823,817 | 7/1974 | Hughes | 206/349 |
| 3,921,804 | 11/1975 | Tester | 206/531 |
| 4,084,695 | 4/1978 | Halbich | 206/532 |
| 4,163,496 | 8/1979 | Doghotti | 206/538 |
| 4,253,572 | 3/1981 | Halbich | 206/538 |

OTHER PUBLICATIONS

Borin Products, Inc.-advertising flier.

*Primary Examiner*—Joseph Man-Fu Moy
*Attorney, Agent, or Firm*—Zarley, McKee, Thomte, Voorhees & Sease

[57] ABSTRACT

A medication dispenser includes a container defining a plurality of open topped medication compartments adapted to be closed by a compartment cover assembly including a plurality of individual covers connected together by fracturable links. Each cover includes an integral fracturable tab depending from one end and coacting means on the container and tabs for securing the tabs in snap-fit relation when the cover is positioned to close its respective compartment. Thus each tab is independently secured relative to the container and fractured from its respective cover in response to upward movement of the opposite end of the cover to open the compartment.

16 Claims, 10 Drawing Figures

MEDICATION DISPENSER

BACKGROUND OF THE INVENTION

This invention relates generally to medication dispensers and more particularly to a multiple-unit container including several unit-dose compartments.

United States Pharmacopeia Xix defines unit-dose container as a single-unit container so designed that the contents are administered to the patient as a single dose, direct from the container. Single-unit container is defined as one that is closed in such manner that none of the contents may be removed without obvious destruction of the closure, and the contents of which are intended for use promptly after it is opened. Accordingly, each compartment of a multiple-unit container must meet the above definitions in order to be used in compliance with current federal regulations. Several such containers have been previously proposed such as those disclosed in U.S. Pat. Nos. 3,921,804 and 4,084,695.

It is desirable in the dispensing of medication to patients that as much chance of error in the administration of the medication be eliminated as is feasibly possible. The package of U.S. Pat. No. 3,921,804 permits a pharmacist to place the unit dosages in the individual compartments and to seal the same therein. A nurse simply breaks the seal on the individual pocket when the dosage is being administered. Although this package has been generally successful, the removal of medication from an individual compartment requires potentially destructive pressure to be exerted against the medication to force it through the perforated seal on the opposite side of the compartment. Furthermore, the slits in the compartment seals may permit the undetected removal of certain forms of medication and finally, the outer shell of that container requires a paper seal or other adhesive means to prevent removal of the entire compartment containing insert therefrom.

In the pillbox of U.S. Pat. No. 4,084,695, the cover assembly for the individual compartments is simply frictionally held in place with no positive locking of the covers onto the compartments to prevent the undetected removal of medication.

Therefore, it is a principal object of the invention to provide an improved medication dispensing container.

A further object of the invention is to provide a medication dispenser constructed to prevent the undetected removal of medication from any unit-dose compartment thereof.

A related object of the invention is to provide a medication dispenser wherein each individual compartment cover is independently locked onto the dispenser.

Another object of the invention is to provide a medication dispenser wherein each compartment cover includes a depending tab which is positively snap-fit onto the dispenser whereby the tab must be fractured to remove the cover.

Another object of the invention is to provide a medication dispenser with a compartment for collecting the fractured tabs from the covers.

A still further object of the invention is to provide a medication dispenser which is economical to manufacture, durable in use and refined in appearance.

SUMMARY OF THE INVENTION

The medication dispenser of the present invention includes a unitary container having several unit-dose compartments formed therein. The covers for the containers each include a depending integral fracturable tab adapted to be independently snap-fit onto the container. As a result, each cover is positively locked in a closed position over its respective compartment and can be opened only by fracturing the integral tab thereof.

A plurality of covers may be interconnected by fracturable links to form a unitary cover assembly which may be easily handled and fit onto the container for quickly and easily closing all of its compartments. Furthermore, a pair of dispensers according to the invention may be coupled together to form a single larger dispenser suitable for more frequent dispensing of medication during a standard period of time.

No pressure is exerted against the medication itself when a compartment cover is opened and no additional seals or adhesives are required to complete the closure of the medication dispenser. The independent securement of each compartment cover to the dispenser affords positive protection against the undetected removal of medication from any compartment.

DESCRIPTION OF THE PREFERRED EMBODIMENT

Figure 1:
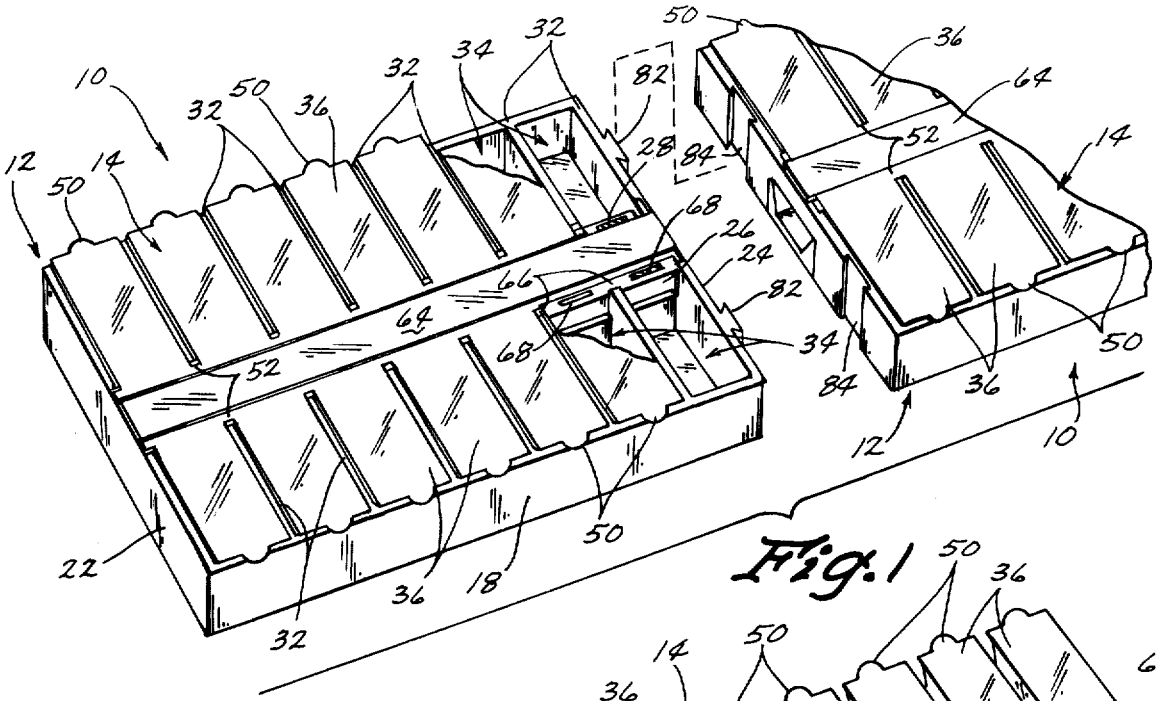
FIG. 1 is a perspective view indicating the dovetail connection between adjacent housings and with portions of the compartment covers broken away to show the interior housing structure.

A medication dispenser 10 according to the present invention is seen in FIG. 1 as including a container 12 and a pair of compartment cover assemblies 14.

Figure 3:
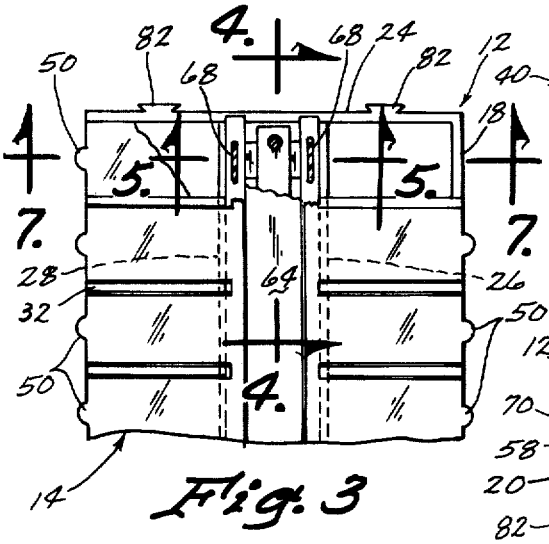
FIG. 3 is a partial top view of the medication dispenser with portions of the compartment covers broken away to disclose the underlying structure.

Container 12 includes a bottom wall 16, opposite upstanding side walls 18 and 20, opposite upstanding end walls 22 and 24 and at least one divider wall 26 extended between the end walls in spaced relation from side wall 18. A second divider wall 28 is positioned in spaced relation from the other side wall 20 and from divider wall 26 so as to form an elongated channel or chamber 30 (FIGS. 3 and 5) between the divider walls.

A plurality of partitions 32 are connected to and extended between each divider wall and one side wall to define a plurality of open topped medication compartments 34.

Figure 2:
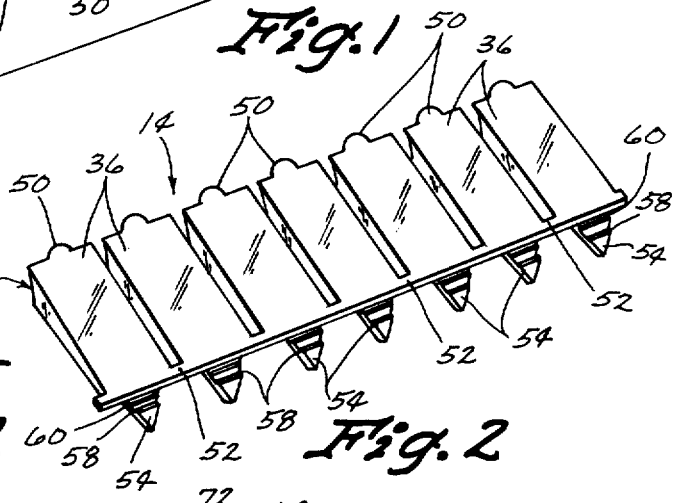
FIG. 2 is a perspective view of a compartment cover assembly.
Figure 6:
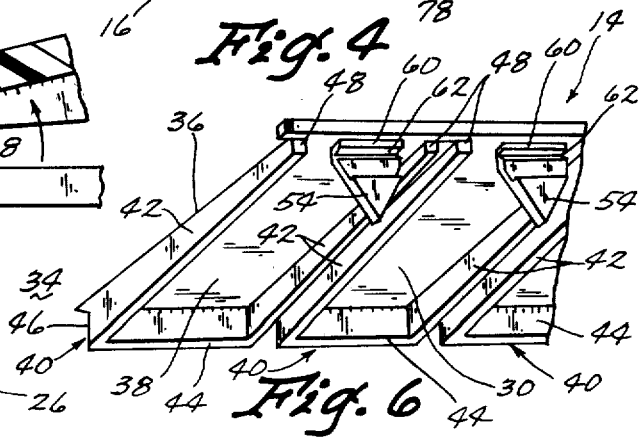
FIG. 6 is an enlarged partial perspective view showing the underside of a compartment cover assembly.
Figure 7:
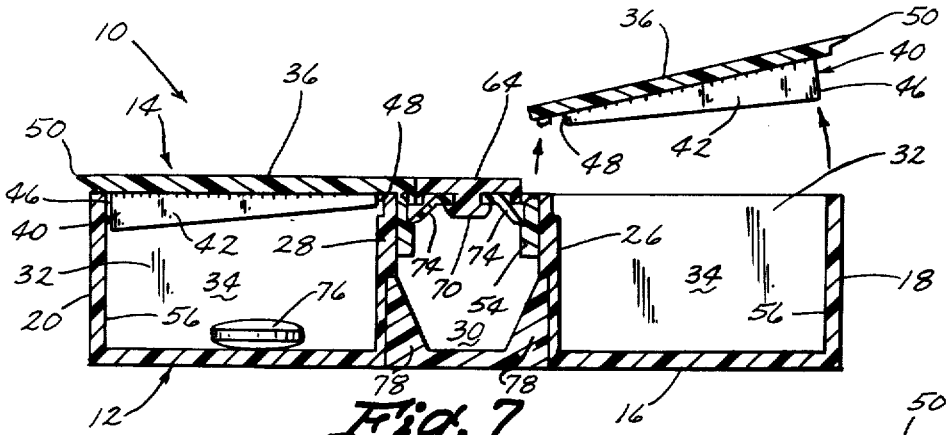
FIG. 7 is an enlarged transverse sectional view taken along line 7—7 in FIG. 3.

FIG. 2 shows a unitary cover assembly 14 which includes a sufficient number of individual compartment covers 36 for closing all of the compartments 34 along one side wall of the container. In FIGS. 2 and 6, it is seen that each individual cover 36 includes a horizontally extended top plate 38 having a U-shaped flange 40 depending from its underside and adapted for close fit against the partitions and side wall forming each compartment when the cover is positioned to close the compartment. Each flange includes a pair of elongated spaced apart legs 42 which are interconnected at their outer ends by a cross member 44. The legs are somewhat deeper at their outer ends 46 (FIG. 6) and shallower at their inner ends 48 for a purpose described below. A semicircular extension 50 on the outer end of each top plate 38 facilitates lifting the cover to open a compartment. The inner ends of adjacent covers are interconnected by fracturable links 52 so that a plurality of the covers may be handled as an integral assembly 14.

An important feature of each compartment cover 36 is the depending tab 54 which functions to independently secure each compartment cover to container 12. Each tab is a generally flat downwardly tapering member arranged parallel to the divider wall of its respective compartment. It is positioned adjacent the inner end of the tab 54 so as to be slidably inserted along the interior surface 56 (FIG. 5) of the associated divider wall. Each tab is further provided with an upwardly facing shoulder 58 on the interior side thereof and a weakened upper portion 60 formed by a notch 62 adjacent the juncture of the tab to the cover top plate 38.

Before describing the connection of the covers to the container, a description of the remaining structure of the container 12 would be helpful. Referring to FIG. 1, it is seen that a top wall 64 extends between and is connected to the upper edges of both divider walls 26 and 28. In the embodiment shown, each divider wall includes a plurality of interiorly directed and spaced apart projections 66 along its upper edge for supporting the elongated strip indicated by reference numeral 64 in FIG. 1. In any event, the assembled top wall interconnecting the divider walls 26 and 28 defines a plurality of elongated spaced apart openings 68 for receiving the tabs 54 of the compartment covers 36.

Figure 4:
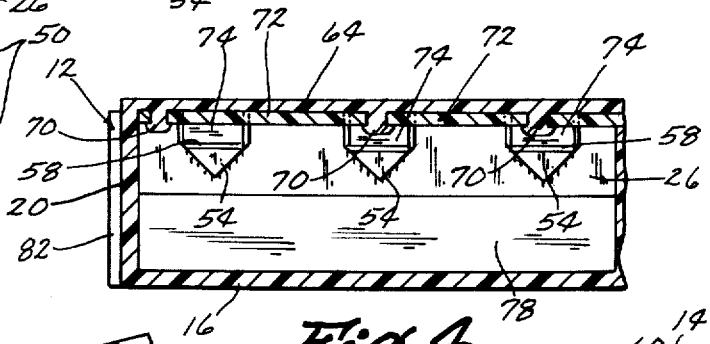
FIG. 4 is an enlarged side sectional view taken along line 4—4 in FIG. 3.
Figure 5:
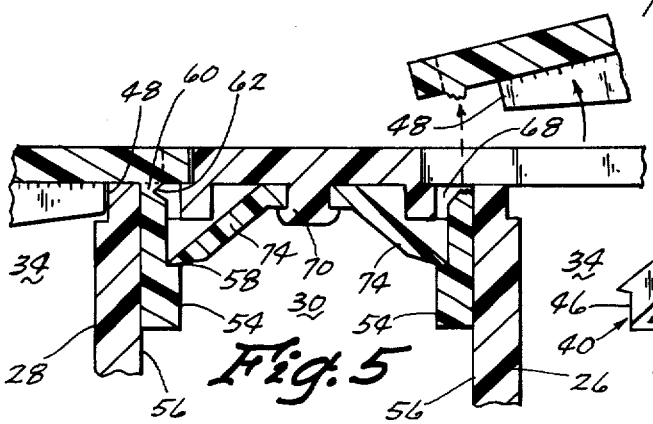
FIG. 5 is a further enlarged sectional view taken along line 5—5 in FIG. 3.

In FIGS. 4 and 5, it is seen that the underside of top wall 64 includes a plurality of fasteners 70 for supporting a strip 72 which includes a plurality of spaced apart downwardly and exteriorly inclined pawls 74.

Figure 8:
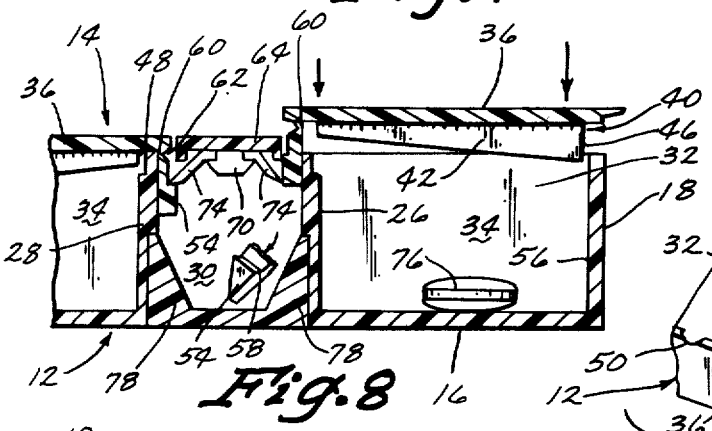
FIG. 8 is a transverse sectional view similar to FIG. 7 but showing the insertion of a new compartment cover.

Referring to FIG. 8, it is seen that when a compartment cover 36 is applied onto the container, the tab 54 deflects the pawl 74 downwardly to allow passage of the tab through the slot defined between the pawl 74 and divider wall 26. As the cover reaches its seated position on divider wall 26 and side wall 18, the upwardly facing shoulder 58 on tab 54 is moved downwardly of pawl 74 allowing it to snap back against the tab above the shoulder so as to function somewhat like a ratchet to prevent vertical upward removal of the tab through opening 68.

When a compartment is to be opened, the outer end of cover 36 is pivoted upwardly which results in the fracture of the tab 54 at weakened portion 60 as indicated in FIG. 5. Similarly, the fracturable link 52 connecting that cover to adjacent covers is similarly fractured. In FIG. 5, it is seen that the fractured tab 54 is held in place by the pawl 74. After the medication in all of the compartments is dispensed, the compartments may be refilled with medication such as the pill 76 indicated in FIG. 8 and a new cover assembly 14 is applied. In FIG. 8, it is seen that the tab 54 of the new cover 36 serves to dislodge the former tab 54 from the pawl 74 allowing it to fall downwardly between the divider walls. For this purpose, a generally U-shaped channel section 78 is secured between divider wall 26 and 28 to close the bottom of chamber 30 for collecting the discarded tabs. Note that the vertical legs of channel 78 are inclined downwardly and interiorly so as to offset the vertical disposition of the dislodged tab. The inclined surface thus prevents a tab from being supported by static electricity in vertical relation against the divider wall and thereby blocking the entry of a tab 54 of a new compartment cover.

Figure 9:
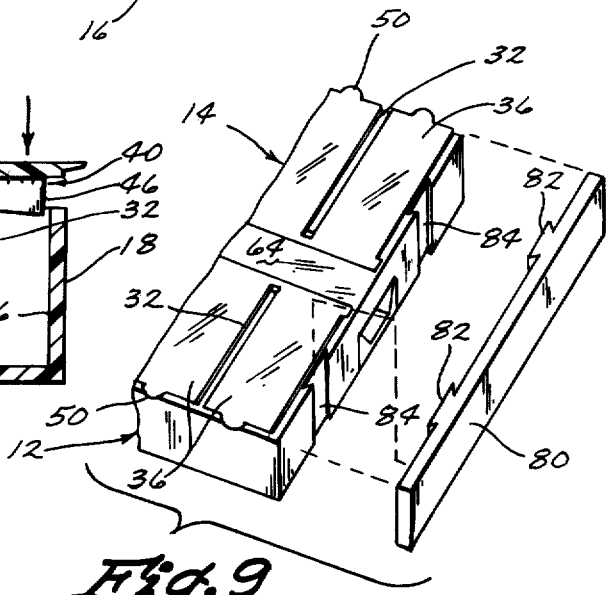
FIG. 9 is a perspective view of the housing and end closure.

In FIG. 9, it is seen that the end of chamber 30 may be closed by a closure plate 80 provided with flaring tenons 82 adapted for receipt within the mortises 84 in the container end wall for a dovetail connection between them.

Figure 10:
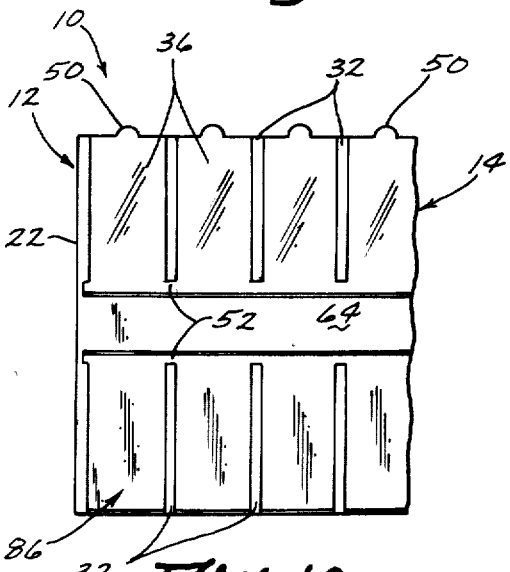
FIG. 10 is a top view of a housing having operative compartments along one side only.

In certain applications, it may be desirable for a pharmacist to package medication only in one row of compartments as where a single pill is to be dispensed daily for seven days. Referring to FIG. 10, this arrangement may be accommodated for by providing a container with a single compartment cover assembly 14 on the row being used and a permanent opaque cover assembly 86 fastened over the opposite row of compartments by adhesives or the like.

Referring again to FIG. 1 wherein each container includes two rows of seven compartments, it may be desirable to couple two containers together in order to accommodate a weekly dose of medication dispensed four times daily. This may likewise be accomplished by providing end walls adapted for a dovetail interconnection as shown. Since there is no closure plate applied to either such end wall, the chambers 30 are thus arranged in communication.

Suitable marking such as the days of the week or numerals may be applied on the top wall strip 64, for example, to facilitate the orderly identification of compartments and the sequence in which the medication is to be administered.

In operation, a pharmacist may place in a container 12 all of the medication required by a given patient for a period of one week and then quickly and easily press the cover assemblies 14 thereon and deliver the filled dispenser to the nurses or authorized aides at a nursing home, hospital or the like. The result is that each prescription need be serviced less frequently which results in substantial time savings for the pharmacist.

Whereas the individual compartment covers are interconnected by the links 52 for easy handling as an integral cover assembly 14, they are nevertheless each independently secured in snap-fit relation onto the container 12 so as to be fully operative regardless of the opening of adjacent compartments.

Thus there has been shown and described a medication dispenser which accomplishes at least all the stated objects.

I claim:

1. A medication dispenser, comprising, a container comprising a bottom, opposite upstanding side walls, opposite upstanding end walls, a divider wall extended between said end walls in spaced relation from one side wall and a plurality of partitions connected to and extended between said divider wall and one side wall to define a plurality of open topped medication compartments, a plurality of compartment covers, each adapted to overlie and close a respective one of said compartments, each cover including a separate integral fracturable tab depending therefrom adjacent one end thereof, and coacting lock means on said container and on the individual tabs for independently securing each tab in snap fit locked relation onto said container when said covers are positioned to close said compartments whereby each cover is fractured from its respective tab in response to upward movement of the opposite end of said cover to open said compartment.

2. The medication dispenser of claim 1 further comprising a plurality of fracturable links, each link being connected to and extended between the said one ends of a pair of adjacent covers whereby the linked covers form an integral cover assembly.

3. The medication dispenser of claim 1 wherein said divider wall has an exterior surface facing said compartments and an opposite interior surface, said tabs being parallel to and engaged against the interior surface of said divider wall when said covers are positioned to close said compartments.

4. The medication dispenser of claim 3 wherein the interior surface of said divider wall is inclined downwardly and away from said compartments whereby a fractured tab which is pushed downwardly on said interior surface is offset from its vertical disposition.

5. The medication dispenser of claim 1 wherein said coacting means comprises an upwardly facing shoulder on each tab and a pawl operatively connected to said container and engageable with said shoulder to prevent upward movement of said tabs relative to said container.

6. The medication dispenser of claim 5 wherein said container further comprises a top wall extended horizontally from an upper portion of said divider wall in a direction away from said compartments and said pawl being secured to said top wall and being inclined therefrom downwardly and toward said divider wall to define a tab receiving slot between said pawl and divider wall.

7. The medication dispenser of claim 6 further comprising a plurality of openings in said top wall for the passage of tabs through said openings into said slots.

8. The medication dispenser of claim 1 wherein said container includes a pair of divider walls disposed in spaced apart relation and further comprising a bottom wall extended between and connected to said divider wall to form a chamber for receiving tabs fractured from their respective compartment covers.

9. The medication dispenser of claim 8 wherein at least one end wall includes a removable portion registered with said chamber for closing one end thereof.

10. The medication dispenser of claim 1 wherein each compartment cover is provided with a depending flange adjacent the opposite end thereof and adapted to be positioned in parallel adjacent relation to said one side wall when the cover is positioned to close its respective compartment.

11. The medication dispenser of claim 1 further comprising coupling means on said container for coupling it to a similar container.

12. The medication dispenser of claim 11 wherein said coupling means comprises a flaring tenon on one end wall and a mortise on the opposite end wall for a dovetail connection to a similar container.

13. The medication dispenser of claim 1 further comprising a second divider wall extended between said end walls in spaced relation from the other divider wall and a plurality of partitions connected to and extended between said second divider wall and the other side wall to define a plurality of additional open topped medication compartments.

14. A compartment cover assembly for a medication dispenser container including a bottom, opposite upstanding side walls, opposite upstanding end walls, a divider wall extended between said end walls in spaced relation from one side wall, a plurality of partitions connected to and extended between said divider wall and one side wall to define a plurality of open topped medication compartments and a plurality of cover lock means on said container adjacent said divider wall, one cover lock means being associated with each compartment, said compartment cover assembly comprising, a plurality of compartment covers, each adapted to overlie and close a respective one of said compartments, each cover including an integral fracturable tab depending therefrom adjacent one end thereof, a plurality of fracturable links interconnecting the said one end of a plurality of covers to form an integral cover assembly, and coacting lock means on each tab adapted for cooperation with a respective cover lock means to secure the respective tab in snap-fit relation onto said container when the covers are positioned to close said compartments whereby each tab is adapted to be independently secured relative to said container and fractured from its respective cover in response to upward movement of the opposite end of said cover to open said compartment.

15. The compartment cover assembly of claim 14 wherein said coacting lock means comprises an upwardly facing shoulder on each tab.

16. The compartment cover assembly of claim 14 wherein each compartment cover is provided with a depending flange adjacent the opposite end thereof and adapted to be positioned in parallel adjacent relation to said one side wall when the cover is positioned to close its respective compartment.

* * * * *